United States Patent [19]

Bell

[11] 4,031,019

[45] June 21, 1977

[54] ALCOHOL ESTERS OF FATTY ACIDS AS USEFUL METALWORKING LUBRICANTS

[75] Inventor: Edward W. Bell, Peoria, Ill.

[73] Assignee: The United States of America as represented by the Secretary of Agriculture, Washington, D.C.

[22] Filed: Oct. 3, 1975

[21] Appl. No.: 619,411

Related U.S. Application Data

[63] Continuation-in-part of Ser. No. 267,314, June 29, 1972, abandoned.

[52] U.S. Cl. ..... 252/56 S; 72/42; 260/410.6

[51] Int. Cl.[2] ..... C10M 1/24

[58] Field of Search ..... 260/410.6; 252/56 S

[56] References Cited

UNITED STATES PATENTS

| | | | |
|---|---|---|---|
| 2,757,139 | 7/1956 | Matuszak et al. | 252/56 S |
| 2,991,297 | 7/1961 | Cooley et al. | 252/56 S X |
| 3,048,608 | 8/1962 | Girard et al. | 252/56 S X |
| 3,130,159 | 4/1964 | Stedt | 252/56 S X |
| 3,200,629 | 8/1965 | James et al. | 252/56 S X |
| 3,252,909 | 5/1966 | Jenks | 252/56 S X |
| 3,360,465 | 12/1967 | Warman | 252/56 S |
| 3,468,701 | 9/1969 | Hughes | 252/56 S X |
| 3,526,596 | 9/1970 | Kress et al. | 252/56 S X |
| 3,620,290 | 11/1971 | Kress et al. | 252/56 S X |
| 3,915,872 | 10/1975 | Sturwold et al. | 252/56 S X |

*Primary Examiner*—Delbert E. Gantz
*Assistant Examiner*—Andrew H. Metz
*Attorney, Agent, or Firm*—M. Howard Silverstein; David G. McConnell; Curtis P. Ribando

[57] ABSTRACT

Alcohol esters of fatty acids and their method of preparation are disclosed. Their high viscosities, smoke, flash, and fire points make these materials useful as lubricants in the continuous casting of steel and when sulfurized, as extreme pressure lubricant additives.

8 Claims, No Drawings

ALCOHOL ESTERS OF FATTY ACIDS AS USEFUL METALWORKING LUBRICANTS

BACKGROUND OF THE INVENTION

This is a continuation-in-part application of Ser. No. 267,314, filed June 29, 1972, now abandoned.

This invention relates to compounds prepared by direct esterification of fatty acids and certain alcohols or by transesterification of vegetable oils with alcohols. It further relates to compounds prepared by sulfurization of the alcohol esters. The compounds as claimed herein are useful as lubricants in the continuous casting of steel and as extreme pressure lubricant additives.

The continuous casting of steel is considered as one of the major technological advances in the steel industry in recent years. In conventional steelmaking, up to 30% of the steel poured is lost in ingot trimming and mill scale; continuous casting cuts these losses down to 10% or less. Continuous casting produces billets and slabs with no ingot pouring and reheating before rolling—processes required in the handling of blooms. Because of economic advantages there has been a continuous growth in this new steelmaking method. The capacity for continuous casting of steel in this country is about 40 million tons per year. Domestic steelmakers express the belief that eventually about half their production will roll off a continuous line. Based on the use of 4–6 ounces of lubricant per ton, a substantial market for lubricants for continuous casting of steel is developing.

The most important function of a mold lubricant is to prevent sticking. Without continuous and reliable lubrication of the mold walls, the steelmaking process slows down or stops. The most widely used lubricants to date have been rapeseed oil high in erucic acid and a blend of rapeseed oil with a more viscous mineral oil. Blown rapeseed is selected primarily because it does not penetrate into the surface of the steel. Crambe, another high erucic oil, in plant-scale tests by the steel industry, proved superior to rapeseed oil in continuous casting of steel. Other oils tried as lubricants are silicone, fish and mineral, as well as paraffin wax, inorganic salts, and mixtures of fatty acids and graphite [W. G. Ritter, Iron Steel Eng., February 1967, pp. 113–118; and Nieschlag et al., JAOCS 48: 723–727 (1971)]. Mixtures of dimer and trimer of unsaturated fatty acids, a glyceride oil, and a mineral lubricating oil have also been reported, U.S. Pat. No. 3,640,860.

The properties which make the above compositions useful as lubricants in the continuous casting of steels are:

1. A viscosity of at least 100 SUS at 100° F.;
2. A high flash point, at least 500° F. for forging grade steel;
3. A high fire point; and
4. A smoke point that is sufficiently high as to permit the steel mold interface to be visually observed.

It is an object of the invention to provide compositions prepared from vegetable oils which have the physical properties described above.

In accordance with the objects of the invention, I have prepared compositions consisting essentially of a mixture of compounds having the general structure:

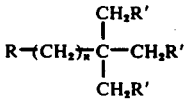

where $n = 1$, R = H—, $CH_3$—, or R′; or where $n = 2$, R = H—, or $CH_3$—; where R′ = isolinoleoyloxy radicals which are defined herein to include all radicals having the structure:

$$CH_3(CH_2)_xCH{=}CH(CH_2)_yCH{=}CH(CH_2)_zCO_2-$$

$x = 1$ to 4, $y = 1$ to 4, $z = 7$ or 8, and $x + y + z = 12$; or where R′ = isooleoyloxy radicals which are defined herein to include all radicals having the structure:

$$CH_3(CH_2)_xCH{=}CH(CH_2)_yCO_2- \quad \text{or} \quad CH_2{=}CH(CH_2)_{15}CO_2-$$

$x = 0$ to 9, $y = 5$ to 14, and $x + y = 14$; or where R′ = stearoyloxy radicals having the structure: $CH_3(CH_2)_{16}CO_2$—; or where R′ = palmitoyloxy radicals having the following structure: $CH_3(CH_2)_{14}CO_2$—. These radicals are present in the mixture in the same proportions as their precursors, the corresponding fatty acids, were present in the partially hydrogenated vegetable oils employed as starting materials. Thus, the mixture contains from a trace to about 45 mole percent of isolinoleoyloxy radicals, from about 44 to about 76 mole percent of isooloeyloxy radicals, from about 3 to about 18 mole percent of stearoyloxy radicals, and from about 5 to about 13 mole percent palmitoyloxy radicals. The mixture also contains from a trace to about 59 mole percent isolated trans double bonds, from 0 to about 16 mole percent conjugatable double bonds, and from a trace to about 40 mole percent nonconjugatable double bonds. The diene double bonds contained in isolinoleoyloxy radicals which are present in the mixture have cis-cis, cis-trans, and trans-trans configurations.

U.S. 3,526,596 and 3,620,290 disclose compositions similar to those of the instant invention. However, when compared to the instant compositions and to crambe and rapeseed oils, the properties of these prior art compositions proved to be substantially inferior as continuous steel casting lubricants. The superiority of the compositions prepared in accordance with the invention is believed to be due not only to the presence of isooleoyloxy and isolinoleoyloxy radicals, but also to the presence of trans double bonds, and nonconjugatable double bonds, which are not included in the prior art compositions.

Some of the above compositions were sulfurized and evaluated as extreme pressure (EP) and antiwear (AW) lubricant additives in an effort to find a sperm oil substitute from sources other than petrochemical. Extreme pressure additives prevent destructive metal-to-metal contact in lubrication at high pressure and/or temperature such as that found in certain gear elements in automotive vehicles and various industrial machines where high pressure can cause a film of lubricant to rupture. EP/AW lubricants should have good lubricity, good cooling properties, high film strength, good load bearing ability and miscibility with the usual types of base oils. Sulfurized sperm oil (SSO) satisfies these requirements and has been used extensively in EP/AW additives.

Novel EP/AW lubricant additives were discovered which consisted essentially of the sulfurized products of the reaction of 12 parts of elemental sulfur and 100 parts of a mixture of compounds having the following formula:

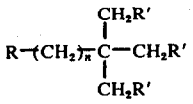

where $n = 1$ or 2; R = H— or $CH_3$—; or a mixture of compounds having the following formula:

$$CH_3(CH_2)_nCH_2R'$$

where $n$ = 4, 6, 8, 10, 12, 14, 16, or 18 in relative proportions of 0.1, 0.1, 0.7, 39.9, 30.4, 17.9, 10.2, and 0.7 mole percent, respectively; and where R' in each formula equals isolinoleoyloxy, isooleoyloxy, stearoyloxy, or palmitoyloxy radicals. Each mixture of compounds contains a relative portion of the radicals of from a trace to about 45 mole percent of isolinoleoyloxy radicals, from about 44 to about 76 mole percent of isooleoyloxy radicals, from about 3 to about 18 mole percent of stearoyloxy radicals, and from about 5 to about 13 mole percent of palmitoyloxy radicals. The mixtures also contain from a trace to about 59 mole percent of isolated trans double bonds, from 0 to about 16 mole percent of conjugatable double bonds, and from a trace to about 40 mole percent of nonconjugatable double bonds. The EP/AW lubricant additive is further characterized as containing from 8.6 to 11.5% sulfur by weight, having a pour point of from 39° to 80° F., a freezing point of from 34° to 75° F., a flash point of from 402° to 462° F., a fire point of from 473° to 515° F., a saponification number of from 135 to 197, a neutral point of from 4.8 to 5.8, and a viscosity at 210°, SUS of from 383 to 1850.

Detailed Description of the Invention

Suitable starting materials for use in preparation of the compositions of the invention include free fatty acid mixtures obtained from soybean oil (SBO) partially hydrogenated with Ni catalyst (Ni-HSBO) or with copper-on-silica gel catalysts (Cu-HSBO) or linseed oils (LSO) partially hydrogenated with copper-on-silica gel catalysts (Cu-HLSO). Suitably free fatty acid mixture (Ni-HSBA, Cu-HSBA, and Cu-HLSA, respectively) contain essentially no linolenic acid or isomers of linolenic acids, but do contain from a trace to about 45 mole percent of isolinoleic acid (i.e., $CH_3(CH_2)_xCH{=}CH(CH_2)_yCH{-}CH(CH_2)_zCO_2H$, where $x = 1$ to 4, $y = 1$ to 4, $z = 7$ or 8, and $x + y + z = 12$), from about 44 to about 76 mole percent of isooleic acid (i.e., $CH_3(CH_2)_xCH{=}CH(CH_2)_yCO_2H$ or $CH_2{=}CH(CH_2)_{15}CO_2H$, where $x = 0$ to 9, $y = 5$ to 14, and $x + y = 14$), from about 3 to about 18 mole percent of stearic acid, from 5 to 13 mole percent palmitic acid, from 14 to 59 mole percent isolated trans double bonds, only traces of conjugated double bonds, from about 0 to about 16 mole percent of conjugatable double bonds, and from a trace to about 40 mole percent nonconjugatable double bonds.

Suitable alcohols for use in accordance with the invention include the polyols trimethylolethane (TME), trimethylolpropane (TMP), trimethylolbutane (TMB), pentaerythritol (PE), ethylene glycol (EG), and also $C_{18}$ saturated cyclic alcohols ($C_{18}$-SCA), and mixtures of primary saturated alcohols (PSA). Other vegetable oils mixtures and other alcohols suitable for use in accordance with the invention will be known to those skilled in the art.

Generally, alcohol esters were prepared by refluxing the desired partially hydrogenated soybean or linseed fatty acids and alcohol in the presence of 0.5% of a catalyst consisting of three parts by weight of calcium acetate and one part of barium acetate with xylene. In esterifications conducted with polyhydric alcohols a 1–2% excess of the stoichiometric amount of hydrogenated fatty acid was used. Water of esterification was removed, the reaction mixture washed with water, dried and stripped of solvent, and excess fatty acids removed by high-vacuum distillation. Analysis of esters showed no hydroxyl present and acid values less than 2.8.

Physical properties of viscosity, smoke, flash, and fire points were determined for the products, the hydrogenated soybean oil starting materials, rapeseed oil, crambe oil, and sperm oil. A comparison of the Brookfield viscosities showed that the Ni-HSBA ester products had pour points lower than the melting points reported for crambe or rapeseed oils. Some of these esters became semisolid at temperatures of from 0° to 73° F. but remained pumpable at 0° F. Viscosities were also determined in a Cannon-Fenske-Ostwald viscosimiter at 100° and 210° F. and converted to Saybolt Universal viscosities (SUS). With the exception of EG, $C_{18}$-SCA, and PSA esters of Cu-HSBA and Cu-HLSA the alcohol esters had viscosities ranging from 239 to 399 SUS at 100° F. compared to 216, 246, and 109 for rapeseed, crambe oil, and sperm oil, respectively.

It was not possible, using available laboratory equipment, to obtain exact fire points for all examples. However, when exact fire points could not be obtained, the temperature at which the samples either boiled over or began to decompose with charring were recorded. These temperatures ranged from 781° to 851° F. for the alcohol esters (except for the PSA ester of Cu-HSBA) and were 806°, 815°, and 655°–675° for rapeseed, crambe oil, and sperm oil, respectively. Flash points of the alcohol esters ranged from 545° to 662°F. while rapeseed, crambe, and sperm oil and flash points of 689°, 680°, and 490° F., respectively. Alcohol esters' smoke points were lower than those of rapeseed and crambe oil; 320° to 464° F. as compared to 489° and 518° F. Sperm oil smoke point was from 275° to 325° C.

EG and PSA esters of Cu-HLSA, and TME and TMB esters of Ni-HSBA were sulfurized and evaluated as sulfurized sperm oil substitutes for EP/AW additives in four base oils used in automotive and industrial applications. TMP esters of Cu-HLSA, TMB esters of Cu-HSBA, and PE esters of Ni-HSBA polymerized during sulfurization and were not evaluated as EP/AW additives. However, they are useful as additives in other lubricant systems, such as greases. Table 7 shows the performance comparison of SSO replacements in engine crankcase base oil (AA), engine transmission base fluid (BB), R G 0-100 gear lubricant (CC), [100/100 viscosity] solvent extracted neutral oil (DD), and Topaz S105 paraffin oil (Topaz S105). A winterized SSO and two commercial SSO substitutes (Comm Sub A, Comm Sub B) are included for comparison. It should be emphasized that many commercial sulfurized replacements are sold as "packages" containing a number of additives such as viscosity improver, metal-deactivator, antioxidants, EP agents, etc. Additives are used extensively in petroleum-based lubricants as well as in synthetic lubricants. The sulfurized esters of hydrogenated fatty acids contained no additives nor were they winterized before sulfurization. SSO replacements were added to each base oil at 10% by weight concentration levels. The blended oils were stored for 24 hours at 35° F., 24 hours at room temperature, 24 hours at 35° F., and then 1 month storage at room temperature. All sulfurized materials had good solubilities in all base oils.

Although data suggest that Topaz S105 was a reasonable choice for screening candidates materials, it was also observed that replacements performed differently in each of the base oils and therefore the choice of a given additive will depend on the intended applications. The EP tests were made using a Precision Scientific Four-Ball EP tester (1440 r.p.m.) in which loads were successively increased first in 20- and then 10-kg. increments until an immediate seizure occurred, representing the weld point. The scar diameters were determined using a Precision Four-Ball Wear tester. The samples were run for 1 hour at 600 r.p.m. at 120° C. and under a 50-kg. load with and without additive. After cleaning the balls with naphtha and hexane, the scar diameters were measured using a microscope assembly (Precision Scientific Co., Chicago, Illinois). All sulfurized products showed both EP characteristics and antiwear properties. At 5% concentration in Topaz S105 sulfurized PSA and EG esters of Cu-HLSA and TME esters of Ni-HSBA exhibited EP properties better than those of SSO, and Comm Sub A and B; and the sulfurized EG esters of Cu-HLSA and TME esters of Ni-HSBA showed better antiwear properties than the commercial products. The sulfurized PSA esters of Cu-HLSA, and the sulfurized TME and TMB esters of Ni-HSBA additives appeared to the effective EP agents, but gave copper corrosion test of 3B to 4C. The higher corrosion ratings and antiwear values may have been due to either a too high sulfurization level and/or sulfur contained impurities. For these reasons EP and antiwear tests were run with a PSA ester of Cu-HLSA containing 8.6% sulfur as a 5% blend in Topaz S105. The additive showed EP test-weld of 200 kg., and wear test-scar of 0.530 mm. As expected this additive gave a lower EP test-weld value than additives containing 10.8% sulfur but the wear test-scar was greatly improved. Copper corrosion tests run with the additive containing 8.6% sulfur as a 10% blend in base oils AA, BB, CC, and DD showed acceptable copper corrosion values of 2A–2B. These results would indicate that with proper adjustment of sulfur concentration and/or addition of metal-deactivators, the additives would possibly have greatly improved EP, antiwear, and anti-copper corrosion properties.

In base oils AA, BB, CC, and DD PSA esters of Cu-HLSA containing 10.8% sulfur and TMB esters of Ni-HSBA containing 10.5% sulfur exhibited lead corrosion tendencies much less than those of SSO and Comm Sub A and B. PSA esters of CU-HLSA containing 8.6% sulfur and EG esters of Cu-HLSA containing 11.2% sulfur showed higher than expected lead corrosion in base oils BB, CC, and DD.

Values of kinematic viscosity data, viscosity indices, and API gravities of all materials tested as 10% blends in the four base oils are within most industrial and military specifications for lubricants containing EP additives. With the exception of the viscosities of PSA esters of Cu-HLSA containing 8.6% sulfur at 100° and 210° F., values for all additives were comparable. The higher viscosity values would indicate the presence of high molecular weight compounds formed during sulfurization. This observation is additional evidence for the possibility of improving EP, antiwear, and anticopper corrosion properties of the sperm oil replacements by proper adjustment of sulfur concentration or sulfurization method. Emulsion test data of additives as 10% blends in the four base oils are summarized: Most of additives form stable emulsion with the four base oils and are suitable for marine engine lubrication and cutting oils. Sulfurized EG esters of Cu-HLSA in base oil CC is similar to Comm Sub B in base oil CC in that they appear to be more suitable for steam-turbine lubrication. However, sulfurized PSA esters of Cu-HLSA in base oil BB and in base oil CC exhibit excellent deemulsification properties and should find application in force-feed circulating lubrication systems provided that the other physical and chemical properties required of such system are also met.

Foam test data of additives as 10% blends in the four base oils are summarized: With the exception of sulfurized EG esters of Cu-HLSA in base oil BB, all candidate additives met the foam test requirements in the four base oils. In base oil BB sulfurized PSA esters of Cu-HLSA, sulfurized TMB esters of Ni-HSBA, SSO, and Comm Sub A showed no foaming tendency. All additive materials foamed extensively in base oil DD; however, sulfurized PSA esters of CU-HLSA and TMB esters of Ni-HSBA exhibited the least foaming tendency of all the additive materials. Table 8 shows results of thermal stability test. Sulfurized PSA esters of Cu-HLSA met all of the thermal stability specification requirements except for percent viscosity increase. However, gear lubricants, in addition to EP additives contain appropriate antioxidants to prevent such viscosity increase as obtained in this test. In this test, the loss of copper catalyst was low. This result was surprising because the thermal stability test is more rigorous than the copper corrosion test.

Since most lubricants are formulated with not one but a number of additives, each having certain performance characteristics, it could not be expected that the sperm oil replacement candidates would meet all lubricant specification requirements. However, it was observed that the additives prepared in accordance with the invention had good EP properties and were superior to a commercial additive in regard to lead corrosion and foaming tendencies. The copper corrosion exhibited by the candidate additives is higher than desired but a significant improvement in that respect can be made by the use of an appropriate metal deactivator and/or antioxidant.

Ni-HSBO starting materials were obtained commercially, while Cu-HSBO and Cu-HLSO were prepared in the laboratory with a 15% copper-on-silica gel (Cu-on-$SiO_2$) catalyst prepared according to the method of Koritala [JAOCS 49: 83 (1972)].

The high-pressure hydrogenations were conducted as follows: A 6-gal. autoclave was charged with 6 liters of commercially refined and bleached soybean oil (acid value 0.01, anisidine value 1.48) and 56 g. of heated activated Cu-on-$SiO_2$ catalyst (0.1% CuO by volume of the oil). After the vessel was purged with nitrogen and pressurized with hydrogen to 500 p.s.i. at room temperature, the charge was heated with stirring to 170° C. Exothermic reactions were controlled with a cooling coil. Hydrogen pressure was then maintained at 600 p.s.i. for 7.5 hours. The progress of the hydrogenation was followed by sampling periodically and determining the refractive indices of filtered oil samples. When the desired refractive index was reached, the autoclave was cooled to 80° C. After the batch was filtered with filter aid, the product and intermediate samples were analyzed. In the hydrogenation of linseed oil intermediate samples were not taken. The hydrogenations were conducted until the hydrogen uptake was nil over a period of 0.25 hour.

In the following examples Ni-HSBO, Cu-HSBO, and Cu-HLSO, and their free fatty acids (FFA) obtained by saponification of the glyceride oils, were used as starting materials for the preparation of the claimed compounds. The FFA were analyzed for neutralization equivalent (N.E.). Methyl esters were prepared from the FFA and analyzed by gas-liquid chromatography (GLC) on a gas chromatograph equipped with a hydrogen flame detector and a 6 ft. × ¼ in. O.D. stainless-steel column packed with 10% EGSS-X on Gas Chrom P, 100-120 mesh (organosilicon polyester packing, Applied Science Laboratories, Inc., State College, Pa.). The column was held at 170° F. with a helium flow of 35 ml./minute. Iodine value (IV) was calculated from GLC analysis or determined by official AOCS Method Cd 1–25.

Alkali isomerizations were carried out for 1 hour and the total amounts of conjugatable diene and triene were measured by AOCS Official Method Cd 7–58, "Official and Tentative Methods of the American Oil Chemists' Society," Vol. 1, 3rd Edition, AOCS, Champaign, Ill., 1964. Nonconjugatable diene and triene were determined by the difference between total diene and triene by GLC analyses and conjugatable diene and triene by UV analysis. Percent isolated trans double bonds were determined by IR analyses.

Viscosities of fatty esters were determined in Cannon-Fenske-Ostwald viscometers. The viscosity indexes were obtained from viscosities at 100° and 210° F. by ASTM Method D2270, "American Society for Testing and Materials," Part 17, Revised to 1967, Philadelphia, Pa. The kinematic viscosity was converted to SUS according to ASTM Method D2161.

Four-ball EP tests were made in accordance with ASTM Method 2596-69, four-ball wear test ASTM Method 2266-67, neutral number ASTM Method D-974, and freezing and pour points ASTM Method D97-57. Sulfur, analysis, base oil solubility test, and copper strip corrosion test were made in accordance with ASTM Method D135-65, API gravity at 60° F. ASTM Method D287-64, lead corrosion test FTM 5321 (Federal Test Methods Standard No. 791B), foam test ASTM Method D892, emulsion test ASTM Method D1401-64, n-pentane and benzene insolubles ASTM Method D893-52 T, and thermal stability FTM 2504-1.

Viscosities of oils and esters were determined with a Brookfield viscometer. Graduated 600-ml. low-form Griffin beakers were charged with 450-ml. samples and covered with watch glasses. Beakers were placed in moisture-proof plastic bags, flushed with nitrogen, and stored from 50 to 168 hours in 73°, 50°, 40°, 34°, 0°, and −20° F. constant temperature rooms. At given temperatures, measurements were made at different shear rates.

Smoke, flash, and fire points were measured by the Cleveland open flash cup procedure, ASTM D92-33, and AOCS Official Method Cc 9a-48.

Compositions were determined for four Ni-HSBO's (Ni-HSBO-A, -B, -C, and -D), four Cu-HSBO's (Cu-HSBO-E, -F, -G, and -H), and six Cu-HLSO's (Cu-HLSO-I, -J, -K, -L, -M, and -N), Table 1. Ni-HSBO-A through -D also were analyzed for Brookfield viscosity and for smoke, flash, and fire points, Table 2.

The following examples are intended only to further illustrate the invention and should not be construed as limiting the scope of the invention which is defined by the claims.

EXAMPLE 1

A mixture of 944 g. (3.42 mole) of the FFA of Ni-HSBO-B, 132 g. (1.1 mole) technical grade TME, 5 g. of a catalyst consisting of three parts by weight of calcium acetate and one part of barium acetate, and 0.55 liter of xylene were placed in a 5-liter flask fitted with a condenser and a Bidwell-Stirling moisture trap. The mixture was refluxed for a period of 8 hours, during which the theoretical amount of water was collected in the moisture trap. The product was transferred to a separatory funnel and washed with distilled water to remove catalyst, dried over sodium sulfate, and filtered. Xylene was eliminated from product by distillation at 30–40 mm. Excess fatty acids were removed from product by distillation at 1 mm. or less. Product (1015 g.) had acid value 2.3, iodine value 78.3, and $N_D30$ 1.4561. IR analysis of esters showed no free hydroxyl. The products were analyzed as described previously, Table 3.

Table 1

| Partially hydrogenated vegetable oil | GLC analysis | | | | Diene % | | trans Isolated % | IV |
|---|---|---|---|---|---|---|---|---|
| | Palmitic | Stearate | Isooleic | Isolinoleic | Conjugatable | Nonconjugatable | | |
| Ni-HSBO-A | 9.2 | 4.6 | 46.9 | 39.3 | 15.5 | 23.8 | 13.8 | 104.3 |
| Ni-HSBO-B | 12.6 | 7.3 | 65.2 | 14.9 | 0.2 | 14.7 | 40.8 | 82.9 |
| Ni-HSBO-C | 10.4 | 7.9 | 75.8 | 5.9 | 0.3 | 5.6 | 43.8 | 71.8 |
| Ni-HSBO-D | 10.7 | 18.0 | 71.8 | tr | 0 | tr | tr | 60.9 |
| Cu-HSBO-E | 10.1 | 4.0 | 75.2 | 10.7 | 4.3 | 6.4 | 39.8 | 83 |
| Cu-HSBO-F | 11.3 | 6.0 | 67.7 | 14.8 | 5.0 | 9.8 | 34.6 | 84 |
| Cu-HSBO-G | 10.1 | 4.1 | 67.6 | 18.0 | 6.2 | 11.8 | 35.5 | 89 |
| Cu-HSBO-H | 10.3 | 3.3 | 76.0 | 10.5 | 1.1 | 9.4 | 23.2 | 84 |
| Cu-HLSO-I | 5.9 | 4.5 | 50.1 | 39.5 | 0.0[a] | 39.5 | 54.0 | 112 |
| Cu-HLSO-J | 5.8 | 4.9 | 43.9 | 45.4 | 5.8[a] | 39.6 | 56.7 | 116 |
| Cu-HLSO-K | 5.3 | 6.9 | 51.9 | 35.9 | 2.8[a] | 33.1 | 58.6 | 106 |
| Cu-HLSO-L | 5.8 | 4.9 | 54.1 | 35.2 | 3.2[a] | 32.0 | 56.8 | 108 |
| Cu-HLSO-M | 6.0 | 5.8 | 45.3 | 42.9 | 7.3[a] | 35.6 | 47.8 | 113 |
| Cu-HLSO-N | 5.9 | 5.0 | 45.3 | 43.8 | 5.6[a] | 38.2 | 51.0 | 115 |

[a]These HLSO also contained from 0.0 to 0.19% conjugatable trienes.

Table 2

| Partially hydrogenated vegetable oil | N.E. | Brookfield viscosities, cp. at ° F. 73 | 50 | 40 | 34 | 0 | Points, ° F. Smoke | Flash | Fire |
|---|---|---|---|---|---|---|---|---|---|
| Ni-HSBO-A | 271.9 | 69.5 | 142 | 367 | 1370 | Semi-solid | 446 | 644 | 790[a] |
| Ni-HSBO-B | 276 | 2205 | Solid | — | — | — | 437 | 626 | 788[a] |
| Ni-HSBO-C | 279.9 | Solid | — | — | — | — | 446 | 608 | 842 |
| Ni-HSBO-D | 279 | Solid | — | — | — | — | 401 | 653 | 797 |

[a]Not fire point; sample boiled over side of cup.

In the determination of Brookfield viscosities, crystals were sometimes present, and the viscosities of the products of this and other examples changed with a change in the rate of shear. Because of this non-Newtonian behavior of the instant esters, the viscosities given in the tables should be considered as relative and not absolute values. Cannon-Fenske-Ostwald viscosities were also determined at 100° and 210° F. The viscosity indexes were obtained from viscosities at 100° and 210° F. by ASTM Method D2270. The kinematic viscosity was converted to SUS according to ASTM Method D2161.

Physical properties of crambe and rapeseed oils are included in Table 3 for comparison. Commercial, crude, crambe oil from Ashland Oil Company, Mapleton, Ill., was washed with alkali to give an acid value of 0.67. The rapeseed oil, a Swedish variety, was processed with phosphoric acid treatment, neutralization, addition of citric acid, bleaching, and deodorization.

PE esters of soybean oil (PE-SBO) were prepared as an example of the compositions disclosed in U.S. Pat. Nos. 3,526,596 and 3,620,290, supra. Analytical results of the esters were included in Table 3 for comparison with the esters prepared in accordance with the invention. Viscosities and viscosity index of PE-SBO were substantially below those reported for the instant composition. The smoke point of PE-SBO was totally unacceptable. The flash point was acceptable, but the fire point was impossible to determine because of the dense smoke generated by the sample.

EXAMPLES 2–4

The FFA of Ni-HSBO-A, -C, and -D were reacted with TME (Examples 2, 3, and 4, respectively) in a molar ratio of 3.1:1 and analyzed as described in Example 1, Table 3.

EXAMPLES 5–8

The FFA of Ni-HSBO-A, -B, -C, and -D were reacted with TMP (Examples 5, 6, 7, and 8, respectively) in a molar ratio of 3.1:1 and analyzed as described in Example 1, Table 3.

EXAMPLE 9

A mixture of 389.4 g. (0.44 mole) Ni-HSBO-A, 45.4 g. (0.33 mole) pure grade PE, and 2 g. of a catalyst consisting of three parts by weight of calcium acetate and one part of barium acetate were placed in a 1-liter flask fitted with thermometer well, magnetic stirrer, heating mantle, condenser, and receiving flask. The mixture was heated at 200°–240° C. and 25-30 mm. pressure for 4 hours. Distillate (42.8 g.) was collected (theory: 40.5 g.). Product was taken up in 250 ml. diethyl ether, washed three times with water to remove catalyst and any residual glycerol, dried over sodium sulfate, filtered, and stripped of solvent on a steam bath. Product had acid value 0.1, iodine value 106.4, and $N_D30$ 1.4709. IR analysis of esters showed no free hydroxyl group. Physical properties of the product were determined as in Example 1, Table 3.

EXAMPLES 10–12

Ni-HSBO-B, -C, and -D were reacted with PE (Examples 10, 11, and 12, respectively) in approximately a 1:1 molar ratio as described in Example 9 and analyzed as described in Example 1, Table 3.

EXAMPLES 13–16

Ni-HSBO-A, -B, -C, and -D were reacted with TMB (Examples 13, 14, 15, and 16, respectively) in approximately a 1:1 molar ratio as described in Example 9 and analyzed as described in Example 1, Table 3.

Table 3

| Example No. | IV | Viscosity, cp. at ° F. 73 | 50 | 40 | 34 | 0 | −20 | Points, ° F. Smoke | Flash | Fire | Viscosity, SUS, ° F. 100 | 210 | Visc. index | $N_D30$ |
|---|---|---|---|---|---|---|---|---|---|---|---|---|---|---|
| 1 | 78.3 | 95 | 172[b] | 629[b] | 1085 | Semi-solid | — | 342 | 535 | 825[c] | 239 | 58.7 | 191 | 1.4651 |
| 2 | 97.1 | 108 | 186 | 650[b] | 1565[b] | 6900[c] | Plastic | 401 | 635 | 851[d] | 270 | 62.4 | 195 | 1.4697 |
| 3 | 69.3 | 2895[b] | Semi-solid | — | — | — | — | 320 | 518 | 788[e] | 263 | 58.5 | 169 | 1.4631 |
| 4 | 59.3 | 638[b] | Semi-solid | — | — | — | — | 365 | 572 | 831[e] | 281 | 64.0 | 197 | 1.4630 |
| 5 | 99.1 | 90 | 170 | 219 | 270 | 846 | 42,000[b] | 464 | 644 | 806[e] | 251 | 59.9 | 192 | 1.4695 |
| 6 | 80.0 | 144 | 280 | 1223 | 805 | Plastic | — | 437 | 608 | 806[e] | 297 | 62.9 | 176 | 1.4670 |
| 7 | 67.2 | 117 | 2985 | Plastic | Semi-solid | — | — | 437 | 653 | 842[e] | 295 | 62.5 | 179 | 1.4657 |
| 8 | 58.6 | 119[c] | Semi-solid | — | — | — | — | 455 | 635 | 842[e] | 307 | 64.7 | 184 | 1.4648 |
| 9 | 106.4 | 125 | 214 | 578 | 3780[c] | Plastic | — | 401 | 662 | 797[d] | 297 | 63.0 | 171 | 1.4709 |
| 10 | 80.0 | 157 | 1425[c] | Semi-solid | — | — | — | 392 | 545 | 815[d] | 371 | 76.6 | 204 | 1.4689 |
| 11 | 70.2 | 193[b] | Semi-solid | — | — | — | — | 374 | 572 | 824[d] | 435 | 72.1 | 252 | 1.4676 |
| 12 | 61.8 | Semi-solid | — | — | — | — | — | 399 | 622 | 810[e] | 369 | 67.5 | 163 | 1.4657 |
| 13 | 90.8 | 117 | 214 | 310 | 400[b] | Semi-solid | — | 370 | 620 | 842[d] | 286 | 60.9 | 146 | 1.4699 |
| 14 | 79.2 | 117 | 210[b] | Semi- | — | — | — | 374 | 599 | 820[e] | 283 | 58.6 | 246 | 1.4666 |

Table 3-continued

| Example No. | IV | Viscosity, cp. at ° F. 73 | 50 | 40 | 34 | 0 | −20 | Points, ° F. Smoke | Flash | Fire | Viscosity, SUS, ° F. 100 | 210 | Visc. index | $N_D30$ |
|---|---|---|---|---|---|---|---|---|---|---|---|---|---|---|
| 15 | 67.7 | 157[b] | Semi-solid | solid — | — | — | — | 378 | 590 | 810[e] | 297 | 65.0 | 191 | 1.4649 |
| 16 | 58.5 | 142[c] | Semi-solid | — | — | — | — | 374 | 608 | 851[e] | 333 | 63.1 | 158 | 1.4640 |
| Crambe oil | 94 | | | m.p. 43° F. | | | | 518 | 680 | 815[d] | 246 | 61.6 | 240 | 1.4716[f] |
| Rapeseed oil | 109.5 | | | m.p. 28°–14° F. | | | | 489 | 689 | 806[d] | 216 | 57.1 | 204 | 1.4655[f] |
| PE-SBO | 132.8 | — | — | — | — | — | — | 287 | 617 | — | 122 | 19.7 | 141 | 1.4750 |

[b]Crystals settled out.
[c]Slurry of crystals and oil.
[d]Not fire point; sample boiled over side of cup.
[e]Not fire point; sample decomposed with charring.
[f]Refractive index at 40° C.

EXAMPLES 17–19

The FFA of Cu-HLSO-L were reacted with TME (Example 20), TMP (Example 21), and TMB (Example 22) in a molar ratio of 3.1:1 as described in Example 1. The products were analyzed for IV, SUS, viscosity index, and smoke, flash, and fire points as described previously and compared to sperm oil winterized at 45° C., Table 4.

EXAMPLE 20

The FFA of Cu-HLSO-L were reacted with PE in a molar ratio of 4.21:1 as described in Example 1. The product was analyzed as described in Example 17, Table 4.

EXAMPLE 21

The FFA of Cu-HLSO-L were reacted with EG in a molar ratio of 2.03:1 as described in Example 1. The product was analyzed as described in Example 17, Table 4.

EXAMPLE 22

The FFA of CU-HLSO-L were reacted with $C_{18}$ cyclic acids ($C_{18}$-SCA) prepared as described by Bell et al., JAOCS 42: 876 (1965) in a molar ratio of 1:1.01 in the manner described in Example 1. The product was analyzed as described in Example 17, Table 4.

EXAMPLE 23

The FFA of Cu-HLSO-L were reacted with a mixture of $nC_{12}$–$nC_{18}$ primary saturated alcohols ($C_{12-18}$ PSA) in a molar ratio of 1:1.01 as described in Example 1. $C_{12-18}$ PSA has the following physical and chemical properties:

| | | |
|---|---|---|
| Total Alcohol | 97.5 min. | 98.9 |
| GLPC Analysis (100% alcohol basis) | | |
| $C_8H_{13}$ OH, Wt. % | — | 0.1 |
| $C_8H_{17}$ OH, Wt. % | — | 0.1 |
| $C_{10}H_{21}$ OH, Wt. % | 2 max. | 0.7 |
| $C_{12}H_{25}$ OH, Wt. % | 39 ± 3 | 39.9 |
| $C_{14}H_{29}$ OH, Wt. % | 29 ± 3 | 30.4 |
| $C_{16}H_{33}$ OH, Wt. % | 19 ± 3 | 17.9 |
| $C_{18}H_{37}$ OH, Wt. % | 10 ± 2 | 10.2 |
| $C_{20}H_{41}$ OH, Wt. % | 2 max. | 0.7 |
| Alcohol color, APHA | 40 max. | 15 |
| Water, Wt. % | 0.1 max. | 0.05 |
| Iodine Number | 0.7 max. | 0.36 |
| Hydroxyl Number | 250–268 | 260 |
| Saponification Number | 1.0 max. | 1 |

The product was analyzed as described in Example 17, Table 4. The product had an acid value of 0.6 and IR analysis showed no free hydroxyl.

EXAMPLE 24

The FFA of Cu-HLSO-L were reacted with a mixture of $nC_{16}$–$nC_{18}$ PSA ($C_{16-18}$ PSA) in a molar ratio of 1:1.01 as described in Example 1. $C_{16-18}$ PSA has the following physical and chemical properties:

| | | |
|---|---|---|
| Total Alcohol, Wt. % | 97.0 min. | 98.7 |
| GLPC Analysis (100% alcohol basis) | | |
| $C_8H_{13}$ OH, Wt. % | — | Trace |
| $C_8H_{17}$ OH, Wt. % | — | Trace |
| $C_{10}H_{21}$ OH, Wt. % | — | 0.1 |
| $C_{12}H_{25}$ OH, Wt. % | — | 0.3 |
| $C_{14}H_{29}$ OH, Wt. % | 2 max. | 1.1 |
| $C_{16}H_{33}$ OH, Wt. % | 59 ± 4 | 59.9 |
| $C_{18}H_{37}$ OH, Wt. % | 34 ± 4 | 36.1 |
| $C_{20}H_{41}$ OH, Wt. % | 5 max. | 2.5 |
| Alcohol color, APHA | 40 max. | 25 |
| Water, Wt. % | 0.1 max. | 0.05 |
| Iodine Number | 1.5 max. | 0.88 |
| Hydroxyl Number | 213–226 | 216 |
| Saponification Number | 1.0 max. | 0.5 |

The product was analyzed as described in Example 17, Table 4.

EXAMPLES 25–27

The FFA of Cu-HSBO-H were reacted with TME (Example 25), TMP (Example 26), and TMB (Example 27) in a molar ratio of 3.1:1 as described in Example 1. The products were analyzed as described in Example 17, Table 5.

EXAMPLE 28

The FFA of Cu-HSBO-H were reacted with PE in a molar ratio of 4.07:1 as described in Example 1. The product was analyzed as described in Example 17, Table 5.

EXAMPLE 29

The FFA of Cu-HSBO-H were reacted with EG in a molar ratio of 2.03:1 as described in Example 1. The product was analyzed as described in Example 17, Table 5.

EXAMPLE 30

The FFA of Cu-HSBO-H were reacted with $C_{12-18}$ PSA in a molar ratio of 1:1.03 as described in Example 1. The product was analyzed as described in Example 17, Table 5.

Table 4

| Example | IV | Viscosity SUS, ° F. 100 | 210 | Viscosity index | Points, ° F. Smoke | Flash | Fire | $N_D30$ |
|---|---|---|---|---|---|---|---|---|
| 17 | 109.6 | 399 | 66.2 | 129 | 356 | 590 | 815 | 1.4698 |
| 18 | 100.0 | 309 | 64.7 | 201 | 428 | 644 | 813 | 1.4698 |
| 19 | 103.5 | 354 | 69.0 | 143 | 383 | 590 | 833 | 1.4705 |
| 20 | 106.9 | 389 | 73 | 140 | 401 | 635 | 797 | 1.9719 |
| 21 | 112.8 | 133 | 47.0 | 204 | 338 | 527 | 824 | 1.4672 |
| 22 | 54.1 | 155 | 49.3 | 147 | 392 | 572 | 788 | 1.4626[b] |
| 23 | 65.6 | 89 | 42.4 | 235 | 392 | 518 | 781 | 1.4554 |
| 24 | 60.8 | 73[a] | 42.9 | — | 356 | 473 | 788 | |
| Sperm oil | 82 | 109 | 45 | 223 | 275–325 | 490 | 655–675 | |

[a]Determined at 122° F.
[b]$N_D40$.

Table 5

| Example | IV | Viscosity SUS, ° F. 100 | 210 | Viscosity index | Points, ° F. Smoke | Flash | Fire |
|---|---|---|---|---|---|---|---|
| 25 | 78 | 255 | 58.8 | 147 | 360 | 644 | 779 |
| 26 | 76 | 261 | 59 | 144 | 320 | 572 | 788 |
| 27 | 75 | 344 | 64.7 | 200 | 360 | 615 | 788 |
| 28 | 83 | 380 | 76.7 | 146 | 428 | 689 | 761 |
| 29 | 95 | 145 | 48.1 | 163 | 374 | 635 | 788 |
| 30 | 69 | 84.2 | 40.7 | 165 | 338 | 518 | 420 |
| Sperm oil | 82 | 109 | 45 | 223 | 275–325 | 490 | 655–675 |

EXAMPLES 31–35

Two samples of the fatty esters of Example 23, one sample each of the fatty esters of Examples 21, 1, and 14, and a sample of sperm oil were placed in 2,000-ml. 3-necked flasks equipped with an electric heating mantle, a mercury-sealed motor-driven stirrer, and an adapter connected to a vacuum pump. Each sample to be sulfurized was charged with 12 parts of elemental sulfur per 100 parts ester by weight. Then with constant agitation pressure was reduced to 208 mm. and reaction mixtures were heated slowly to 250° F. After about 0.5 hour (this period was utilized to take advantage of the resulting exotherm from the initial reaction), the samples were slowly heated to 360° ± 5° F. After 4 hours of constant stirring the samples were cooled to 200° F. and blown free of $H_2S$ and other sulfur containing species by drawing air through the sample. Each sample was blown until the entrained air tested negative on lead acetate paper.

Each product (Examples 31, 32, 33, 34, 35, and SSO, respectively) was analyzed for percent sulfur, pour point, freezing point, flash point, fire point, saponification number, neutral number, and SUS as previously described, Table 6.

Examples 31–35, SSO, and two commercial SSO substitutes (Comm Sub A and Comm Sub B) were added, at a 10% addition level, to engine crankcase oil (AA), engine transmission base fluid (BB), R G 0-100 gear lubricant (CC), [100/100 viscosity] solvent extracted neutral oil (DD), and Topaz S105 paraffin oil (Topaz S105), and tested for performance as described previously, Table 7. Example 31, SSO, Comm Sub A, and Comm Sub B, at 10% additive concentration in BB and DD, were tested for thermal stability as previously described, Table 8.

Table 6

| Example | 31 | 32 | 33 | 34 | 35 | SSO |
|---|---|---|---|---|---|---|
| Sulfur, % | 10.8 | 8.6 | 11.2 | 11.5 | 10.5 | 11.0 |
| Pour point, ° F. | 51 | 80 | 39 | 60 | 78 | 64 |
| Freezing point, ° F. | 46 | 75 | 34 | 55 | 73 | 59 |
| Flash point, ° F. | 402 | 462 | 448 | 420 | 424 | 464 |
| Fire point, ° F. | 515 | 502 | 480 | 473 | 514 | 536 |
| Saponification number | 213.9 | 135.2 | 192.9 | 197.2 | 153.7 | 166.8 |
| Neutral number | 4.8 | 7.6 | 5.8 | 5.57 | 5.7 | 3.05 |
| Viscosity at 210° F., SUS | 405 | 353 | 418 | 1850 | 383 | |

Table 7

| Base oil | Sulfurized additive Example No. | Extreme pressure weld point, average wear kg. | scar, mm. | copper corrosion | Lead corrosion mg./in.² | Kinematic viscosity Cs at ° F. 100 | 210 | Viscos. index | API gravity degree API 60° F. | Emulsion test, ml. Oil | $H_2O$ | Emul | Foam test, ml.[b] I | II | III |
|---|---|---|---|---|---|---|---|---|---|---|---|---|---|---|---|
| AA | None | 140 | 0.635 | — | — | — | — | — | — | — | — | — | — | — | — |
| | 31 | 360 | 0.640 | 4A | 0.2 | 128.7 | 13.3 | 113 | 27.5 | 2 | 1 | 77 | 20-0 | 70-0 | 10-0 |
| | 32 | — | — | 2A/B | 11.0 | 499.51 | 65.72 | 107 | 28.0 | 1 | 0 | 79 | — | — | — |
| | 33 | — | — | 3B | 26.9 | 125.74 | 13.10 | 107 | 27.8 | 1 | 0.5 | 78 | 0-0 | 45-0 | 0-0 |
| | 34 | — | — | 4A | 7.1 | 129.93 | 13.17 | 118 | 29.3 | 1 | 2 | 77 | 0-0 | 45-0 | 0-0 |
| | 35 | — | — | 4A | 0.0 | 108.8 | 11.8 | 105 | 28.2 | 2 | 0 | 78 | 0-0 | 50-0 | 0-0 |
| | SSO | 300 | 0.583 | 1A/B | 22.5 | 131.19 | 13.57 | 101 | 27.8 | 1 | 0 | 79 | 0-0 | 40-0 | 20-0 |
| | Comm Sub A | 280 | 0.480 | — | 30.3 | 134.19 | 13.61 | 111 | 27.6 | 1 | 0 | 79 | 45-0 | 30-0 | 20-0 |
| | Comm Sub B | 240 | 0.575 | — | 3.5 | 127.97 | 13.20 | 113 | 27.7 | 75 | 0 | 79 | 10-0 | 20-0 | 20-0 |

Table 7-continued

| Base oil | Sulfurized additive Example No. | Extreme pressure weld point, average wear kg. | scar, mm. | copper corrosion | Lead corrosion mg./in.² | Kinematic viscosity Cs at ° F. 100 | 210 | Viscos. index | API gravity degree API 60° F. | Emulsion test, ml. Oil | $H_2O$ | Emul | Foam test, ml.[b] I | II | III |
|---|---|---|---|---|---|---|---|---|---|---|---|---|---|---|---|
| BB | None | 120 | 0.625 | — | — | — | — | — | — | — | — | — | — | — | — |
| | 31 | 320 | 0.712 | 4B | 0.0 | 533.6 | 35.1 | 107 | 24.7 | 8 | 38 | 34 | 0-0 | 0-0 | 0-0 |
| | 32 | — | — | 2A/B | 33.2 | 2046.0 | 31.34 | 110 | 25.8 | 1 | 14 | 65 | — | — | — |
| | 33 | — | — | 3B | 75.7 | 576.25 | 36.66 | 106 | 25.6 | 1 | 10 | 69 | 20-0 | 20-0 | 0-0 |
| | 34 | — | — | 4A | 27.1 | 614.34 | 38.20 | 105 | 26.6 | 16 | 18 | 46 | 120-0 | 90-0 | 0-0 |
| | 35 | — | — | 4A | 0.1 | 434.0 | 31.3 | 108 | 26.0 | 40 | 39 | 1 | 0-0 | 0-0 | 0-0 |
| | SSO Comm | 280 | 0.628 | — | 12.7 | 537.8 | 36.02 | 113 | 25.7 | 9 | 24 | 67 | 0-0 | 0-0 | 0-0 |
| | Sub A Comm | 320 | 0.653 | — | 27.4 | 543.52 | 36.09 | 121 | 25.9 | 5 | 22 | 53 | 0-0 | 0-0 | 0-0 |
| | Sub B | 240 | 0.591 | — | 4.7 | 549.0 | 35.37 | 103 | 25.7 | 40 | 37 | 3 | 0-0 | 10-0 | 0-0 |
| CC | None | 130 | 0.603 | — | — | — | — | — | — | — | — | — | — | — | — |
| | 31 | 360 | 0.698 | 4A | 0.0 | 235.4 | 20.5 | 109 | 25.4 | 21 | 24 | 36 | 0-0 | 40-0 | 10-0 |
| | 32 | — | — | 2A/B | 36.1 | 907.53 | 148.40 | 109 | 26.3 | 4 | 1 | 75 | — | — | — |
| | 33 | — | — | 3B | 22.0 | 242.61 | 20.86 | 108 | 25.9 | 37 | 40 | 3 | 210-0 | 130-0 | 20-0 |
| | 34 | — | — | 3B | 59.7 | 283.96 | 23.84 | 117 | 25.8 | 25 | 0 | 79 | 170-0 | 90-0 | 40-0 |
| | 35 | — | — | 4A | 0.2 | 196.9 | 18.0 | 108 | 25.5 | 23 | 7 | 50 | 0-0 | 40-0 | 0-0 |
| | SSO Comm | 260 | 0.642 | — | 19.0 | 240.77 | 20.94 | 110 | 26.2 | 8 | 11 | 61 | 510-0 | 150-0 | 180-0 |
| | Sub A Comm | 280 | 0.675 | — | 31.4 | 244.79 | 20.9 | 113 | 25.9 | 6 | 20 | 54 | 420-0 | 160-0 | 120-0 |
| | Sub B | 270 | 0.613 | — | 4.6 | 239.76 | 20.75 | 118 | 26.2 | 6 | 15 | 60 | 530-0 | 80-0 | 110-0 |
| DD | None | 110 | 1.020 | — | — | — | — | — | — | — | — | — | — | — | — |
| | 31 | 270 | 0.783 | 4C | 1.1 | 26.6 | 5.0 | 131 | 31.0 | 21 | 24 | 35 | 50-0 | 20-0 | 55-0 |
| | 32 | — | — | 2A/B | 44.7 | 113.35 | 41.25 | 117 | 31.7 | 11 | 14 | 55 | — | — | — |
| | 33 | — | — | 4A | 27.8 | 27.38 | 5.07 | 131 | 30.5 | 12 | 1 | 67 | 160-0 | 50-0 | 20-0 |
| | 34 | — | — | 4A | 77.0 | 27.96 | 5.16 | 141 | 31.5 | 4 | 0 | 75 | 180-0 | 70-0 | 90-0 |
| | 35 | — | — | 4C | 4.6 | 23.7 | 4.6 | 115 | 31.6 | 24 | 21 | 35 | 65-0 | 40-0 | 40-0 |
| | SSO Comm | 300 | 0.697 | — | 12.9 | 27.78 | 5.05 | 122 | 31.4 | 12 | 2 | 66 | 250-0 | 20-0 | 80-0 |
| | Sub A Comm | 360 | 0.713 | 1B | 20.6 | 27.72 | 5.26 | 140 | 31.3 | 33 | 13 | 34 | 220-0 | 20-0 | 100-0 |
| | Sub B | 270 | 0.620 | 1B | 16.8 | 27.68 | 5.09 | 125 | 31.1 | 5 | 0 | 75 | 280-0 | 30-0 | 100-0 |
| Topaz S105 | None | 120 | 0.794 | | | | | | | | | | | | |
| | 31[a] | 300 | 0.735 | | | | | | | | | | | | |
| | 31 | 360 | 0.780 | | | | | | | | | | | | |
| | 32[a] | 200 | 0.530 | | | | | | | | | | | | |
| | 33[a] | 240 | 0.595 | | | | | | | | | | | | |
| | 34[a] | 280 | 0.535 | | | | | | | | | | | | |
| | 35[a] | 220 | 0.673 | | | | | | | | | | | | |
| | SSO[a] | 230 | 0.558 | | | | | | | | | | | | |
| | SSO Comm | 300 | 0.623 | | | | | | | | | | | | |
| | Sub A[a] Comm | 220 | 0.606 | | | | | | | | | | | | |
| | Sub A Comm | 320 | 0.500 | | | | | | | | | | | | |
| | Sub B[a] Comm | 230 | 0.596 | | | | | | | | | | | | |
| | Sub B | 280 | 0.670 | | | | | | | | | | | | |

[a]added at 5% level.
[b]sequence of bubbling 5 minutes and settling 10 minutes: I, at 75° F.; II, at 200° F.; III, at 75° F. after collapsing the foam.

Table 8

| Tests | Sulfurized additive Example 31 | SSO | Comm Sub A | Comm Sub B |
|---|---|---|---|---|
| Vis. inc., %[a] | 194.24 | 107.70 | 100.95 | 171.10 |
| Acid No. | 11.03 | 10.15 | 8.22 | 11.98 |
| Pent. insols.[b] | 1.19 | 0.16 | 0.11 | 2.04 |
| Benz. insols.[c] | 0.96 | 0.11 | 0.09 | 0.85 |
| Catalyst loss, % | 0.24 | 0 | 1 | 2.21 |

Gear lubricant specification limits:
[a]Viscosity increase 100 max.
[b]n-Pentane insolubles 3% by wt. max.
[c]Benzene insolubles 2% by wt. max.

I claim:

1. A continuous steel casting mold lubricant composition consisting essentially of a mixture of compounds having the formula:

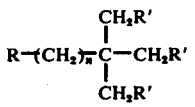

where $n = 1$; R = H—, $CH_3$—, or R′; or where $n = 2$, R = H—, or $CH_3$—; and R′ = isolinoleoyloxy, isooleoyloxy, stearoyloxy, or palmitoyloxy radicals, said mixture of compounds containing from a trace to about 45 mole percent of isolinoleoyloxy radicals, from about 44 to about 76 mole percent of isooleoyloxy radicals, from about 3 to about 18 mole percent of stearoyloxy radicals, and from about 5 to about 13 mole percent of palmitoyloxy radicals, said mixture also containing from a trace to about 59 mole percent of isolated trans double bonds, from 0 to about 16 mole percent of conjugatable double bonds, and from a trace to about 40 mole percent of nonconjugatable double bonds.

2. The composition as described in claim 1 wherein $n = 2$ and R = $CH_3$—.

3. The composition as described in claim 1 wherein $n = 2$ and R = R′.

4. The composition as described in claim 1 wherein $n = 1$ and R = H—.

5. The composition as described in claim 1 wherein $n = 1$ and R = $CH_3$—.

6. The composition as described in claim 1 wherein $n = 1$ and R = R′.

7. A continuous steel casting mold lubricant composition consisting essentially of a mixture of compounds having the formula:

$$CH_3-(CH_2)_n-CH_2-R'$$

where $n$ = 4, 6, 8, 10, 12, 14, 16, or 18 in relative proportion of 0.1, 0.1, 0.7, 39.9, 30.4, 17.9, 10.2, and 0.7 mole percent, respectively, and where R' = isolinoleoyloxy, isooleoyloxy, stearoyloxy, or palmitoyloxy radicals, said mixture of compounds containing from a trace to about 45 mole percent of isolinoleoyloxy radicals, from about 44 to about 76 mole percent of isooleoyloxy radicals, from about 3 to about 18 mole percent of stearoyloxy radicals, and from about 5 to about 13 mole percent of palmitoyloxy radicals, said mixture also containing from a trace to about 59 mole percent of isolated trans double bonds, from 0 to about 16 mole percent of conjugatable double bonds, and from a trace to about 40 mole percent of nonconjugatable double bonds.

8. A continuous steel casting mold lubricant composition consisting essentially of a mixture of compounds having the formula:

$$CH_3-(CH_2)_n-CH_2-R'$$

where $n$ = 4, 6, 8, 10, 12, 14, 16, or 18 in relative proportions of a trace, a trace, 0.1, 0.3, 1.1, 59.9, 36.1, and 2.5 mole percent, respectively, and where R' = isolinoleoyloxy, isooleoyloxy, stearoyloxy, or palmitoyloxy radicals, said mixture of compounds containing from a trace to about 45 mole percent of isolinoleoyloxy radicals, from about 44 to about 76 mole percent isooleoyloxy radicals, from about 3 to about 18 mole percent of stearoyloxy radicals, and from about 5 to about 13 mole percent of palmitoyloxy radicals, said mixture also containing from a trace to about 59 mole percent of isolated trans double bonds, from 0 to about 16 mole percent of conjugatable double bonds, and from a trace to about 40 mole percent of nonconjugatable double bonds.

* * * * *